US007448613B2

(12) United States Patent
Takahashi

(10) Patent No.: US 7,448,613 B2
(45) Date of Patent: Nov. 11, 2008

(54) SHEET FEEDING APPARATUS AND IMAGE FORMING APPARATUS

(75) Inventor: Yoshikazu Takahashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 127 days.

(21) Appl. No.: 11/677,418

(22) Filed: Feb. 21, 2007

(65) Prior Publication Data

US 2007/0200284 A1 Aug. 30, 2007

(30) Foreign Application Priority Data

Feb. 28, 2006 (JP) ..... 2006-053719

(51) Int. Cl.
*B65H 1/26* (2006.01)

(52) U.S. Cl. ..... 271/157; 271/160; 271/162

(58) Field of Classification Search ..... 271/147, 271/157, 160, 162, 145
See application file for complete search history.

(56) References Cited

U.S. PATENT DOCUMENTS 4,280,692 A * 7/1981 Hutchinson et al. ..... 271/160
4,494,746 A * 1/1985 Moser ..... 271/164
5,419,544 A * 5/1995 Ono et al. ..... 271/164
5,564,690 A * 10/1996 Oshida ..... 271/157
5,648,837 A * 7/1997 Tamai ..... 355/72
7,147,219 B2 * 12/2006 Soo ..... 271/157

FOREIGN PATENT DOCUMENTS

JP 03259823 A * 11/1991

* cited by examiner

*Primary Examiner*—Patrick H Mackey
*Assistant Examiner*—Prasad V Gokhale
(74) *Attorney, Agent, or Firm*—Canon U.S.A., Inc. I.P. Division

(57) ABSTRACT

A lifting plate provided in a sheet accommodating member is locked at a position, to which the lifting plate is downwardly turned against a pushing force of a spring, by a locking mechanism having a locking member configured to lock the lifting plate, and also having a lock releasing lever configured to release locking of the lifting plate by the locking member. When the sheet accommodating unit is mounted, the lock releasing lever is made to abut against a lock release member. Thus, the lock releasing lever is moved integrally with the locking member in a lock release direction. When the sheet accommodating unit is drawn out, the lock releasing lever is made to abut against the lock release member. Thus, the lock releasing lever is singly moved in a direction opposite to the lock release direction to maintain the locking of the lifting plate by the locking member.

7 Claims, 7 Drawing Sheets

SHEET FEEDING APPARATUS AND IMAGE FORMING APPARATUS

BACKGROUND OF THE INVENTION

1. Field of the Invention

The present invention relates to a sheet feeding apparatus and to an image forming apparatus employing the sheet feeding apparatus. More particularly, the present invention relates to a device configured to lock a lifting plate provided in a sheet accommodating unit of the sheet feeding apparatus.

2. Description of the Related Art

Image forming apparatuses, such as a printer and a copier, adapted to feed sheets to an image forming unit by a sheet feeding apparatus have nowadays been widely used. Some sheet feeding apparatuses are configured so that a sheet cassette is demountably mounted in an image forming apparatus body so as to facilitate, for example, accommodation and replacement of sheets. With this configuration, the sheet cassette is mounted in the image forming apparatus body. Then, sheets accommodated in the sheet cassette are fed by a pickup roller to the image forming unit.

Meanwhile, such a sheet cassette has a lifting plate that supports a sheet and that is pivotable upwardly and downwardly. When a sheet is fed to the image forming unit of some image forming apparatus, the lifting plate is pushed by a spring toward the pickup roller to press the sheet against the pickup roller. Thus, the sheet feeding apparatus obtains a feeding pressure required to feed the sheet.

In a case where sheets are replenished in the sheet cassette in some image forming apparatus, or where sheets are replaced with those stored in the sheet cassette therein, the sheet cassette is drawn out of the image forming apparatus body. Then, the lifting plate is pushed down against a pushing force of the spring. The lifting plate is locked by a locking mechanism at a descent position to which the lifting plate is pushed down. With this configuration, the replenishment and the replacement of sheets of the sheet cassette can easily be performed.

The locking of the lifting plate by the locking mechanism is released when the sheet cassette is mounted in the apparatus body. Consequently, the lifting plate rises toward the pickup roller when the sheet cassette is inserted into the image forming apparatus body. Thus, the feeding of sheets is enabled.

However, the position of the locking mechanism is such that users can easily operate the locking mechanism. Thus, when replenishing or replacing the sheets, a user may release the locking of the lifting plate by the locking mechanism so that one end of the lifting plate jumps up. Moreover, to fix the lifting plate to the descent position (or lock position), it is necessary to once push down the lifting plate to the descent position before sheets are stacked. This is troublesome.

To solve this problem, a technique discussed in the U.S. Pat. No. 5,564,690 has been developed. This technique is described below with reference to FIG. 6. As shown in FIG. 6, a locking mechanism 50 adapted to lock a lifting plate 102 at a descent position in a sheet cassette 100 is provided substantially at the center of a cassette body 101 of the sheet cassette 100 to be at a lower position than the lifting plate 102. Thus, the locking mechanism 50 can be prevented from erroneous operation by users.

To release the locking of a member by the locking mechanism 50 in a case where the locking mechanism 50 is provided at such a position, a lock release member 60 is provided on a bottom plate 70 in a lower part of an image forming apparatus body 200. FIG. 7 illustrates the locking mechanism 50 in detail. The locking mechanism 50 is pivotably provided in the sheet cassette 100, and is fixed in a position in which the locking mechanism 50 pushes down the lifting plate 102 by being caught onto a latch part 102*a* of the lifting plate 102. As viewed in FIG. 6, the sheet cassette 100 is moved from right to left and is mounted to a cassette mounting unit 201.

At that time, a releasing lever 51 provided in the locking mechanism 50 abuts against the lock release member 60 provided on the bottom plate 70 in the lower part of the apparatus body 200. Then, the locking mechanism 50 is turned in the direction of an arrow shown in FIG. 7. Consequently, the locking of the lifting plate 102 is released. Accordingly, the lifting plate 102 is lifted and pushed by a pushing force of a spring 103 toward a pickup roller 203 provided in the apparatus body 200. Thus, the lifting plate 102 is moved to a sheet feeding position to enable the feeding of sheets.

Meanwhile, a guide unit 65 having a slope 66 is provided on an entrance side surface of the cassette mounting unit 201 of the image forming apparatus body 200. A sliding-contact unit (not shown) protruding laterally from the lifting plate 102 in the sheet cassette 100 slide-contacts on the slope 66. Thus, the lifting plate 102 is pushed down and up along the slope 66 when the sheet cassette 100 is mounted in and is demounted from the image forming apparatus body 200.

When the sheet cassette 100 is drawn out of the image forming apparatus body 200, the lifting plate 102 descends along the slope 66 of the guide member 65 shown in FIG. 6 against the pushing force of the spring 103. The lifting plate 102 is fixed by the locking mechanism 50 at a position, at which the lifting plate 102 is pushed down, before the sheet cassette 100 is drawn out. Thus, the lifting plate 102 is locked in conjunction with an operation of drawing the sheet cassette 100 out of the apparatus body 200. This eliminates necessity for pushing down the lifting plate 102 to stack sheets. Consequently, operability can be enhanced.

Meanwhile, the locking mechanism 50 can be moved to a lock position, at which the lifting plate 102 is locked, and a lock release position at which the locking of the lifting plate is released. When moving to the lock position, the locking mechanism 50 abuts against an abutment part 55 of a sheet cassette body 101, as illustrated in FIG. 7, so that the locking mechanism 50 cannot move in a direction opposite to the lock release position. With this configuration, when the locking mechanism 50 moves to the lock position, the pushing force of the spring 103 locks the lifting plate 102. Consequently, the lifting plate 102 can surely be locked by the locking mechanism 50.

Recently, along with diversification of sheets used, sheet cassettes have been provided in an image forming apparatus as multiple stages. In such an image forming apparatus, a lower-stage sheet cassette (not shown) is mounted under, for example, the sheet cassette 100 shown in FIG. 6. A lower-stage pickup roller (not shown) feeds sheets. A cassette conveyance passage 101*a*, through which a sheet is conveyed from a lower-stage sheet cassette, is provided in each of the sheet cassettes 100. Also, an opening 70*a*, through which a sheet is supplied from an immediately lower stage sheet cassette to the cassette conveyance passage 101*a* of the upper stage sheet cassette 100, is provided in the bottom plate 70 (a partition plate that partitions an accommodating unit, which accommodates the upper stage sheet cassette, from an accommodating unit which accommodates the immediately lower stage sheet cassette) of the image forming apparatus body 200.

In this configuration, it is necessary that the lock release member 60 is provided at one of anterior and posterior positions of the opening 70*a* in a mounting direction of the sheet cassette 100, i.e., at a position (hereunder referred to as an interior position), where the sheet cassette 100 abuts against the locking mechanism 50 just before the mounting of the sheet cassette 100 is completed, or at an entrance side position of the cassette mounting unit 201.

In a case where the lock release member 60 is provided at the interior position of the cassette mounting unit 201, and where the locking of the lifting plate 102 is released when the sheet cassette 100 is mounted in the apparatus body 200, the lifting plate 102 is rapidly pushed up by the spring 103. In such a case, an upward inertia force acts upon each sheet. Thus, when a sheet abuts against the pickup roller 203, a large force is applied to the sheet. Consequently, the posture of a sheet is disturbed when stacked.

In such a case, the sheet feeding performance of the apparatus is degraded. This results in occurrences of sheet feeding failures, such as skew-feeding and non-feeding of sheets. Thus, sometimes, it is necessary to restack the sheets. Also, when a sheet rapidly bumps up against the pickup roller 203, collision noises may be generated, or breakages of the sheet cassette 100 and the pickup roller 203 may be caused.

Meanwhile, in a case where the lock release member 60 is provided at the entrance side of the cassette mounting unit 201, as indicated by dashed lines in FIG. 6, the locking of the lifting plate 102 can be cancelled in an early stage of insertion of the sheet cassette 100. In this case, the lifting plate 102 can moderately be lifted along the slope 66 of each of the guide members 65 provided at both ends of the cassette mounting unit 201. Consequently, each sheet can be prevented from rapidly bumping up against the pickup roller 203.

However, in this case, the lock mechanism 50 cannot turn in a direction opposite to a direction indicated by an arrow shown in FIG. 7. Thus, when the sheet cassette 100 is drawn out, the releasing lever 51 of the locking mechanism 50 is caught in the lock release member 60. Thus, the sheet cassette 100 cannot be drawn out. Accordingly, in the conventional apparatus configured so that the cassette conveyance passage 101*a* is provided in the sheet cassette 100 and that a sheet is fed from a lower stage sheet cassette through the cassette conveyance passage 101*a* to the image forming unit, the locking mechanism 50 adapted to lock the lifting plate 102 cannot be provided under the sheet cassette 100.

SUMMARY OF THE INVENTION

The present invention is directed to a sheet feeding apparatus that can surely achieve locking of a lifting plate and release of the locking of the lifting plate, and prevent occurrence of a sheet feeding failure and of a breakage of a component, and is also directed to an image forming apparatus using such a sheet feeding apparatus.

According to an aspect of the present invention, in a sheet feeding apparatus, a sheet accommodating unit is demountably provided in an apparatus body. The sheet accommodating unit has a sheet accommodating member, a lifting plate pivotably provided in the sheet accommodating member, and a pushing member configured to push the lifting plate toward a sheet feeding unit. The sheet feeding apparatus includes a locking mechanism configured to perform regulation of the lifting plate at a position to which the lifting plate descends against a pushing force of the pushing member, The locking mechanism includes a pivotable locking member configured to regulate the lifting plate, and a pivotable lock releasing lever configured to turn the locking member. A lock release member is provided in the apparatus body and configured to release the regulation of the lifting plate by the locking mechanism, in response to mounting of the sheet accommodating unit in the apparatus body. When the sheet accommodating unit is mounted in the apparatus body, the lock releasing lever is turned by the lock release member and turns the locking member to release the regulation of the lifting plate. When the sheet accommodating unit is drawn out of the apparatus body, the lock releasing lever is turned by the lock release member independently in a state in which the locking member regulates the lifting plate.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
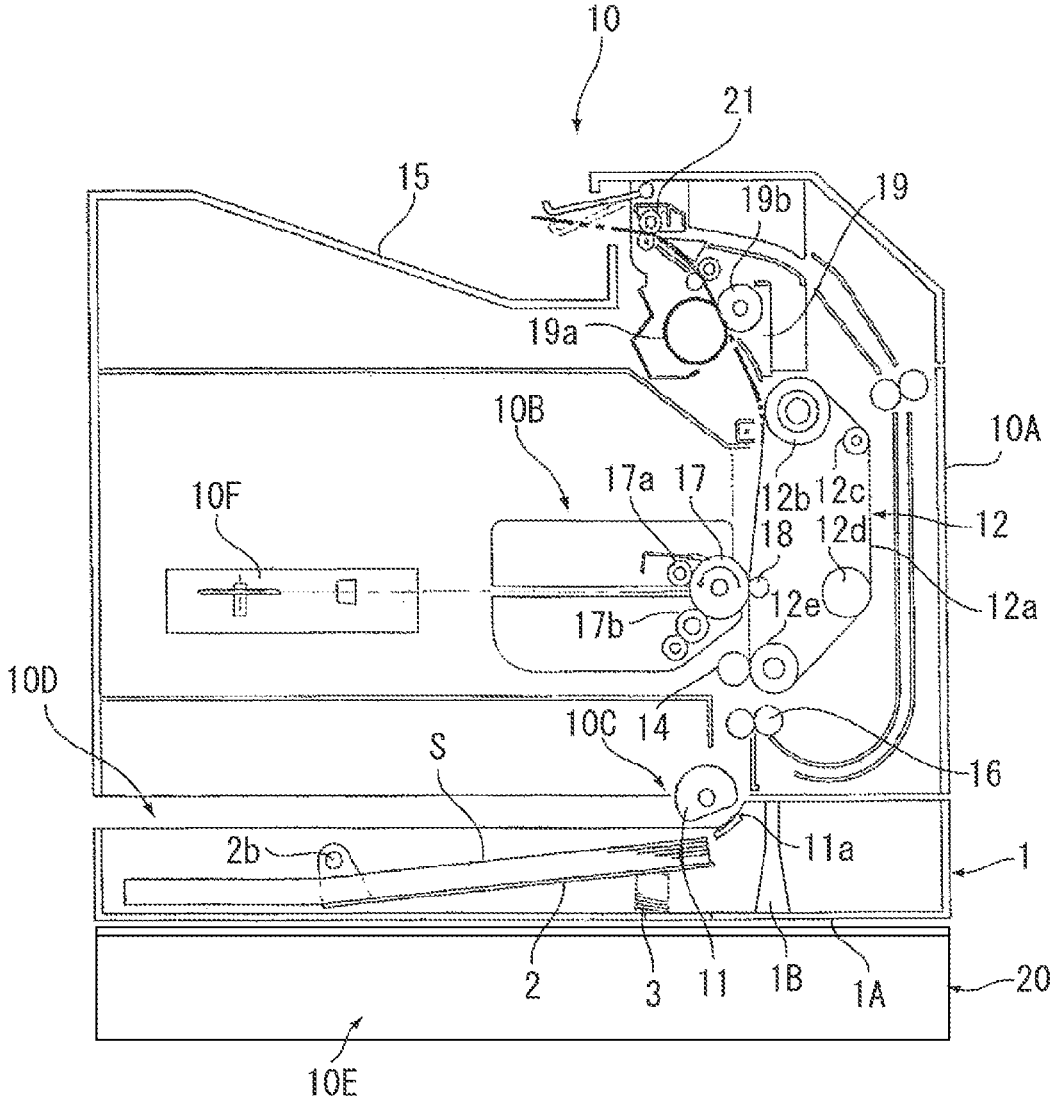
FIG. 1 is a schematic diagram illustrating an example configuration of a laser printer which is an example of an image forming apparatus according to an exemplary embodiment of the present invention.

FIG. 1 illustrates an example configuration of a laser printer which is an example of an image forming apparatus according to an exemplary embodiment of the present invention.

FIG. 1 shows a printer 10 and a laser printer body 10A (hereunder referred to as a printer body). The printer body 10A includes an image forming unit 10B configured to form an image on a sheet, a sheet feeding apparatus 10C configured to feed a sheet, and a sheet conveyance apparatus 12 configured to convey a sheet, which is fed from the sheet feeding apparatus 10C, to the image forming unit 10B. The printer body 10A also includes a fixing apparatus 19 configured to fix an image formed on a sheet.

The image forming unit 10B has a photosensitive drum 17 serving as an image carrier that carries a toner image. The photosensitive drum 17 is rotated counterclockwise by a rotation unit (not shown).

The image forming unit 10B has an electrical charging unit 17*a* configured to uniformly charge a surface of the photosensitive drum 17, and also has a scanner unit 10F configured to irradiate the surface of the photosensitive drum with laser beams according to image information to form an electrostatic latent image thereon. Also, the image forming unit 10B has a developing unit 17*b* configured to visualize an electrostatic latent image as a toner image by making toner adhering to the electrostatic latent image.

A transfer roller 18 is provided inside an endless transfer conveyance belt 12*a* (to be described later) on which a sheet is conveyed, so that the transfer roller 18 and the photosensitive drum 17 sandwich the transfer conveyance belt 12*a*. The transfer roller 18 is connected to a transfer bias power supply (not shown). Positive charges are applied from the transfer roller 18 to a sheet through the transfer conveyance belt 12*a*. Negative toner images are serially transferred onto a sheet, which is in contact with the photosensitive drum 17, by applying a transfer bias thereto in this way.

The sheet feeding apparatus 10C includes a sheet cassette 1 serving as a sheet accommodating unit. The sheet cassette 1 includes a plurality of sheets S and is demountably mounted in a cassette mounting unit 10D provided at a bottom part of the printer body 10A constituting a sheet feeding apparatus body. As viewed in FIG. 1, the sheet cassette 1 is moved from right to left and is mounted to a cassette mounting unit 10D in the printer body 10A. Further, the sheet feeding apparatus 10C has a pickup roller 11 serving as a sheet feeding unit that feeds the sheets S accommodated in the sheet cassette 1.

A lower stage cassette mounting unit 10E is disposed under the cassette mounting unit 10D. A lower stage sheet cassette 20 is demountably provided in the lower stage cassette mounting unit 10E. The configurations of the lower stage sheet cassette 20 and a feeding mechanism, such as a pickup roller, adapted to feed a sheet from the lower stage sheet cassette 20 are the same as those of the sheet cassette 1 and the sheet feeding apparatus 10C. Thus, the drawing and the description of the lower stage sheet cassette 20 and the feeding mechanism are omitted.

The sheet feeding cassette 1 includes a cassette body 1A constituting the sheet accommodating member, and also includes a lifting plate 2 on which the sheets S are stacked. The lifting plate 2 is provided in the cassette body 1A to be pivotable upwardly and downwardly around a shaft 2*b*. The lifting plate 2 is upwardly pushed by a spring 3, such as a compression spring 3, to press the sheets S against the pickup roller 11.

As shown in FIG. 1, the sheet cassette 20 is disposed under the sheet cassette 1 mounted in the printer body 1A. When an image is formed, the sheets S are separated one by one and are serially fed from the sheet cassette 1 by the pickup roller 11 and a separation unit 11*a*. Subsequently, the sheets S are conveyed to a sheet conveyance unit 12 by a pair of registration rollers 16 with predetermined timing.

The sheet conveyance unit 12 includes a transfer conveyance belt 12*a* serving as a sheet carrier. The transfer conveyance belt 12*a* is looped over a drive roller 12*b* and driven rollers 12*c* to 12*e* and is disposed to face the photosensitive drum 17. The outer circumferential surface of the transfer conveyance belt 12*a*, which is opposed to the photosensitive drum 17, electrostatically adsorbs a sheet. Also, the transfer conveyance belt 12*a* is circulatorily moved clockwise by the drive roller 12*b* to bring the sheet into contact with the photosensitive drum 17.

The sheet is conveyed by the transfer conveyance belt 12*a* to a transfer position being electrostatically adsorbed to the transfer conveyance belt 12*a* which is circulating. Thus, a toner image formed on the photosensitive drum 17 is transferred thereonto.

An electrostatic adsorption roller 14 is disposed at a furthest upstream of the transfer conveyance belt 12*a* and is pressure-contacted to the driven roller 12*e* through the transfer conveyance belt 12*a*. The electrostatic adsorption roller 14 causes the sheet S to be electrostatically adsorbed to the electrostatic transfer belt 12*a* by making the sheet S pressure-contacted to the outer circumferential surface of the transfer conveyance belt 12*a* and by applying a voltage between the electrostatic adsorption roller 14 and the electrostatic transfer belt 12*a*.

A fixing unit 19 is configured to fix a toner image by applying heat and pressure onto an image formed on a sheet. The fixing unit 19 has a fixing roller 19*a* into which a heat source is incorporated, and a pressure roller 19*b*. The pressure roller 19*a* is pressure-contacted to the fixing roller 19*b*. A nip is formed at a contact part between the pressure roller 19*b* and the fixing roller 19*a*.

Next, an image forming operation of the laser printer 10 configured in this manner is described below. First, the electrical charging unit 17*a* applies uniform electric charge on the circumferential surface of the photosensitive drum 17. The scanner unit 10F performs exposure on the circumferential surface of the photosensitive drum 17 according to an image signal to form an electrostatic latent image on the circumferential surface of the photosensitive drum 17. Additionally, the electrostatic latent image is developed by the developing unit 17*b*, so that a toner image is formed on the surface of the photosensitive drum 17.

The sheets S accommodated in the sheet cassette 1 are picked up by the pickup roller 11 in parallel to a toner image forming operation. Subsequently, an edge of the sheet S abuts against the pair of registration rollers 16, so that a loop is formed. Thus, skew of the sheet S is corrected.

After this, the pair of registration rollers 16 start rotating with timing, with which an end of a toner image formed on the surface of the photosensitive drum 17 is conveyed to a contact point (or transfer position) between the surface of the photosensitive drum 17 and the electrostatic transfer belt 12*a*, so that a position on the sheet S, at which printing is started, coincides with the contact point.

Then, the sheet S is conveyed to the nip between the electrostatic adsorption roller 14 and the electrostatic transfer belt 12 by the rotation of the pair of registration rollers 16. The sheet S is adsorbed to the electrostatic transfer belt 12 by the electrostatic adsorption roller 14. Subsequently, the sheet S is conveyed to a transfer unit at which the photosensitive drum 17 and the electrostatic transfer belt 12*a* are pressure-contacted to each other.

Next, a toner image formed on the surface of the photosensitive drum 17 is transferred onto the sheet which has been transferred to the transfer unit, by the action of the transfer roller 18 disposed in the transfer unit to which a voltage having a polarity opposite to the toner is applied.

Then, an edge of the sheet S, onto which the toner image is transferred, is separated from the electrostatic transfer belt 12*a* due to the curvature of the drive roller 12*b*. Subsequently, the sheet S is conveyed to the fixing unit 19. Then, the toner image is fixed onto the sheet S at the fixing unit 19. The sheet S, onto which the toner image is fixed, is discharged to a sheet discharge tray 15 by a pair of fixing discharge rollers 21

Figure 2:
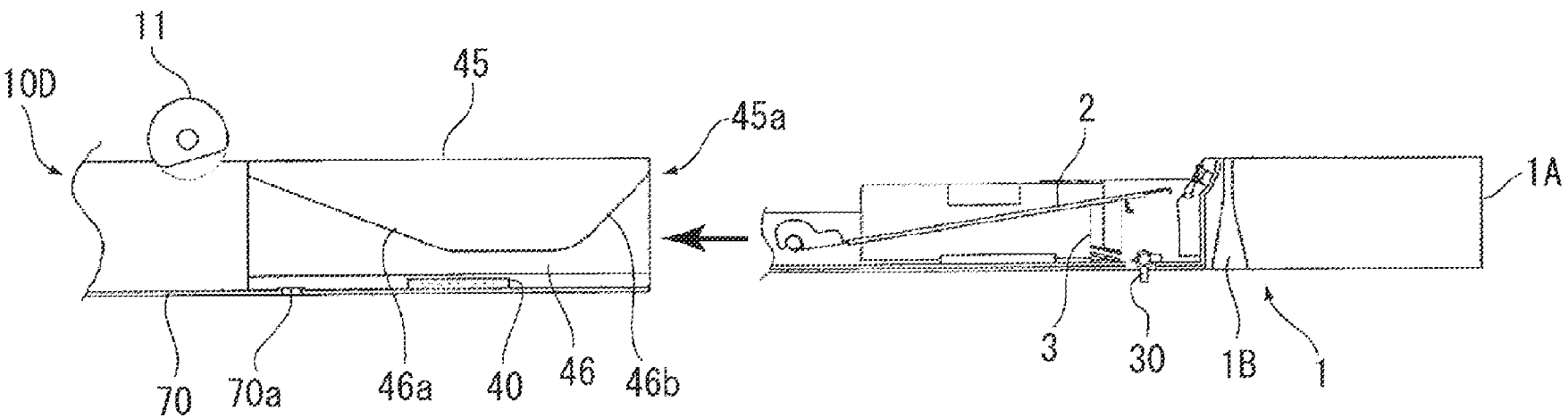
FIG. 2 is a diagram illustrating an example configuration of a cassette mounting unit provided in a printer body of the laser printer and also illustrating the configuration of a sheet cassette demountably mounted in the cassette mounting unit.

As shown in FIG. 2, a guide member 45 having a slope 46 is provided to face each of both side wall surfaces of an entrance-side cassette insertion port 45*a* of the cassette mounting unit 10D, in which the sheet cassette 1 is demountably mounted. The sheet cassette 1 is mounted in a direction of an arrow shown in FIG. 2. When the sheet cassette 1 is mounted thereinto and demounted therefrom, a sliding-contact part (not shown) of the lifting plate 2 upwardly pushed abuts against the slope 46. Also, when the sheet cassette 1 is mounted thereinto and demounted therefrom, the lifting plate 2 is moved along the slope 46 upwardly and downwardly. The sliding-contact part (not shown) is provided at a position, at which the sliding-contact part (not shown) can slide-contact on the slope 46, to protrude from the lifting plate 2 to a side of the sheet cassette 1.

An opening 70*a,* through which a sheet is fed by a lower stage pickup roller (not shown) from the lower stage sheet cassette 20 provided under the sheet cassette 1 to the cassette conveyance passage 1B, is provided in the bottom plate 70 of the cassette mounting portion 10D.

Under the lifting plate 2 in the cassette body 1A, a locking mechanism 30 is disposed at a position corresponding to a central part in a width direction perpendicular to a sheet feeding direction of the lifting plate 2. When the sheets are stacked, the lifting plate 2 can be locked at the descent position (or lock position) against the force of the spring 3 by the locking mechanism 30.

Also, a lock release member 40 adapted to release the locking of the lifting plate 2 in the sheet cassette 1 is provided in a part of the cassette mounting unit 10D, which is closer to the entrance than the opening 70*a*. As will be described later, when the sheet cassette 1 is mounted in the cassette mounting unit 10D, the locking of the lifting plate 2 in the sheet cassette 1 is released by the lock release member 40.

Figure 3:
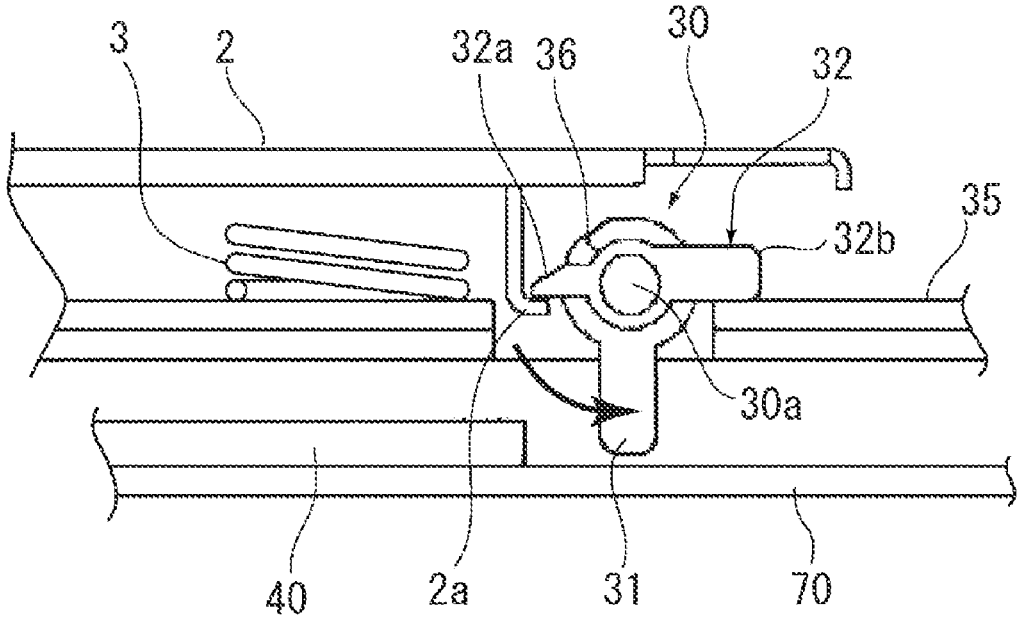
FIG. 3 is a diagram illustrating an example state in which a lifting plate provided in the sheet cassette is locked by a locking mechanism.

Next, the locking mechanism 30 is described below. As shown in FIG. 3, the locking mechanism 30 includes a locking member 32 having a claw part 32*a* serving as a catching part adapted to lock the lifting plate 2 by catching the lifting plate 2 at an end thereof, and also includes a lock releasing lever 31 that is a lock release member separated from the locking member 32. The locking member 32 and the lock releasing lever 31 are pivotably attached to the shaft 30*a*.

Meanwhile, the locking member 32 can be moved to a lock position, at which the lifting plate 2 is locked being caught by the claw part 32*a,* and a lock release position at which the locking of the lifting plate 2 is released by turning the locking member 32 in the direction of an arrow shown in FIG. 3. The locking member 32 is configured so that when moving to the lock position shown in FIG. 3, an abutting part 32*b* of the locking member 32 abuts against an abutment part 35 serving as a regulating unit provided in a sheet cassette body 1A. Thus, the locking member 32 cannot move in a direction (clockwise, as viewed in FIG. 3) opposite to the direction of the arrow.

With this configuration, when the claw part 32*a* is caught by a latch part 2*a* provided on the bottom plate of the lifting plate 2 to protrude therefrom, the pushing force of the spring 103 acts as a force of locking the lifting plate 102. Consequently, the lifting plate 102 can surely be locked. Also, a locked state can be maintained.

The example configuration of the locking mechanism 30 is described below with reference to FIGS. 4A and 4B. The shaft 30*a* of the locking mechanism 30 has a first pushing member 37 that is a torsion coil spring adapted to push the abutting part 32*b* of the locking member 32 in a direction (clockwise, as viewed in FIG. 3) in which the abutting part 32*b* abuts against the abutment part 35. Thus, the locking member 32 is pushed by the first pushing member 37 to thereby maintain the locking member 32 at the lock position of the lifting plate 2, excepting a case that the lifting plate 2 is moved by the lock releasing lever 31, as will be described later. Consequently, the locking of the lifting plate 2 can surely be achieved. The lock releasing lever 31 is operative to release the locking of the lifting plate 2, which is performed by the locking member 32. When the sheet cassette 1 is mounted in the cassette mounting unit 10D, the lock releasing lever 31 is turned in the direction (counterclockwise) of an arrow shown in FIG. 3 by being brought in contact with the lock release member 40 provided in the cassette mounting unit 10D, as illustrated in FIG. 5A (to be described later).

Figure 4A:
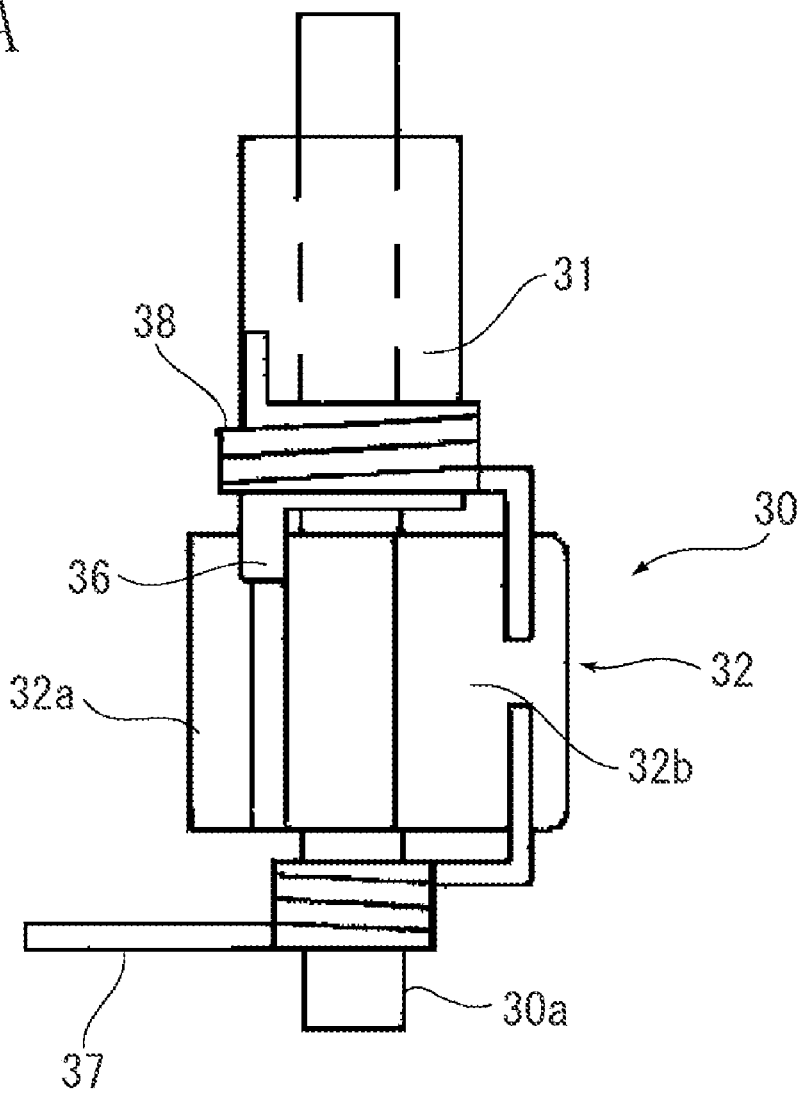
FIGS. 4A and 4B illustrate an example configuration of the locking mechanism.
Figure 4B:
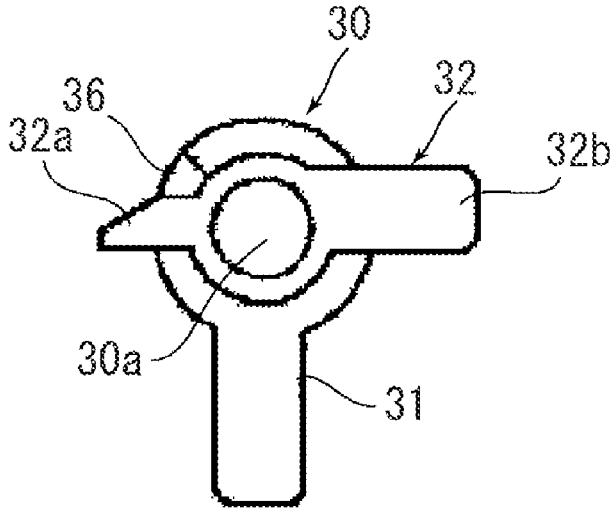
Figure 5A:
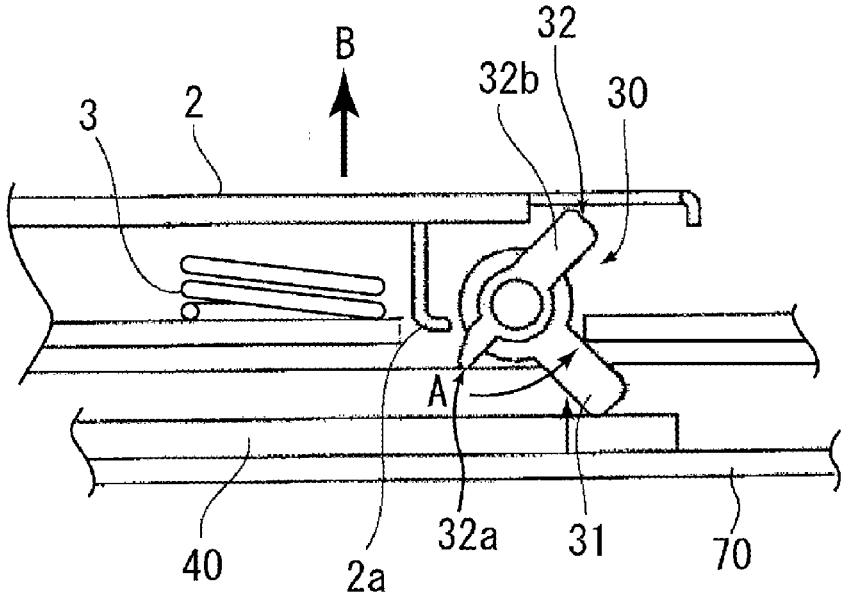
FIGS. 5A and 5B illustrate an example operation of the locking mechanism at mounting/demounting of the sheet feeding cassette.

As shown in FIGS. 3, 4A, and 4B, an engaging part 36 to be engaged with the locking member 32 is provided in the lock releasing lever 31. When the lock releasing lever 31 is turned in the direction of the arrow shown in FIG. 3, the locking member 32 is pushed by the engaging part 36 and is turned integrally with the releasing lever 31. Also, when the locking member is turned in the direction of the arrow, the engagement between the claw part 32*a* and the lifting plate 2 is released, so that the lifting plate 2 is upwardly turned by the pushing force of the spring 3. Thus, the uppermost one of the sheets is moved to the sheet feeding position at which the moved sheet can be fed by the pickup roller 11.

Also, a torsion spring serving as a second pushing member 38 adapted to push the releasing lever 31 in a direction, in which the engaging part 36 is engaged with the locking member 32, as shown in FIG. 4A, is provided in the shaft 30*a* of the locking mechanism 30. When the locking member 32 is placed at a position at which the second pushing member 38 causes the locking member 32 to lock the lifting plate 2, the releasing lever 31 is necessarily directed toward a downward direction. Thus, when the sheet cassette 1 is mounted in the cassette mounting unit 10D, the releasing lever 31 can surely abut against the lock release member 40. Although the first pushing member 37 and the second pushing member 38 are separate members in the present embodiment, the first pushing member 37 and the second pushing member 38 may be constituted by the same pushing member. In this case, the number of components can be reduced.

Next, an exemplary operation of the locking mechanism 30 constituted in this manner is described below with regard to FIGS. 5A and 5B. When the sheet cassette 1 is mounted in the cassette mounting unit 10D, the lock releasing lever 31 is brought into contact with the lock release member 40 provided on the bottom surface of the cassette mounting unit 10*d*. Thus, the lock releasing lever 31 is turned in the direction of an arrow A (counterclockwise), as shown in FIG. 5A.

Then, the locking member 32 is pushed through the engaging part 36. The locking member 32 is also turned in the direction of the arrow A. Consequently, the locking of the lifting plate 2 is released.

In a case where the sheet cassette 1 is mounted in this manner, when the locking of the lifting plate 2 by the locking member 32 is released, the lifting plate 2 is moved by the spring 3 in the direction of an arrow B, so that the sliding-contact part (not shown) provided in the lifting plate 2 is pressure-contacted with the slope 46 of the guide member 45 shown in FIG. 2. As the sheet cassette 1 is inserted in this manner, soon, the lifting plate 2 upwardly moves along a part 46*a* inclined in an upward direction toward a downstream side in a cassette mounting direction of the slope 46.

In the present embodiment, the lock release member 40 is provided at the entrance side part of the cassette mounting unit 10D. The angle of inclination of the downstream side part 46*a* of the slope 46 of the guide member 45 is small. Thus, the lifting plate 2 gradually upwardly moves (or turns). Resultantly, the sheets stacked on the lifting plate 2 are slowly brought into contact with the pickup roller 11. Consequently, the stacked condition of the sheets can be prevented from being disturbed. Also, the generation of the collision noises and the breakage of the cassette can be prevented.

Meanwhile, when the sheet cassette 1 is drawn out, the locking of the lifting plate by the locking member 32 is released as the sheet cassette 1 is moved in a direction in which the cassette 1 is drawn out. The lifting plate 2 moved to the feeding position gradually falls along the slope 46 of the guide member 45 against the pushing force of the spring 3.

The latch part 2*a* of the lifting plate 2 is soon pressure-contacted with the claw part 32*a* of the locking member 32 from above. Consequently, the locking member 32 is turned counterclockwise (in the direction of an arrow A shown in FIG. 5A) against the pushing force of the first pushing member 37. Subsequently, when the lifting plate 2 further falls, the latch part 2*a* of the lifting plate 2 passes through the claw part 32*a* of the locking member 32. Thus, the locking member 32 is upwardly turned by the pushing force of the first pushing member 37.

Consequently, the claw part 32*a* of the locking member 32 is placed above the latch part 2*a* of the lifting plate 2. When the sheet cassette 1 is further drawn out from the cassette mounting unit 10D in this state, soon, the lifting plate 2 is upwardly moved along the part 46*b* (see FIG. 2) of the slope 46, which is upwardly inclined toward the upstream side in the direction in which the cassette is mounted. Then, the lifting plate 2 is caught by the claw part 32*a* of the locking member 32. Thus, the lifting plate 2 is locked.

Figure 5B:
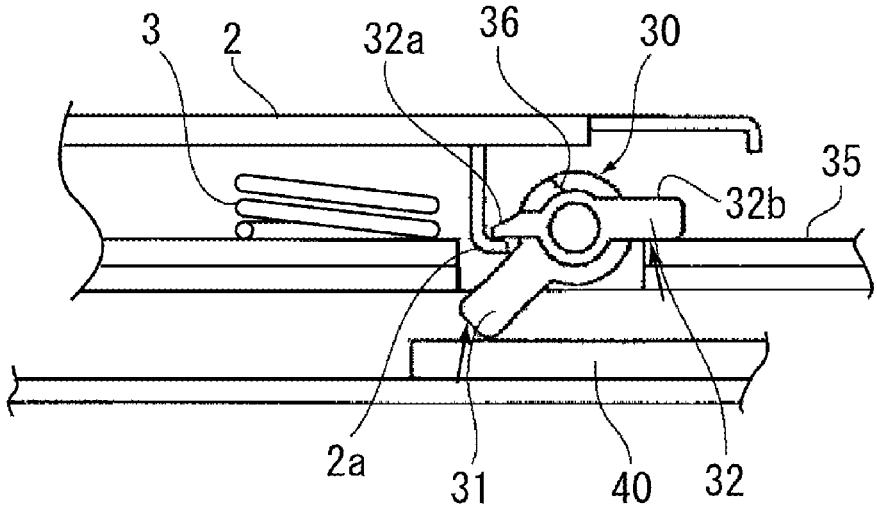
Figure 6:
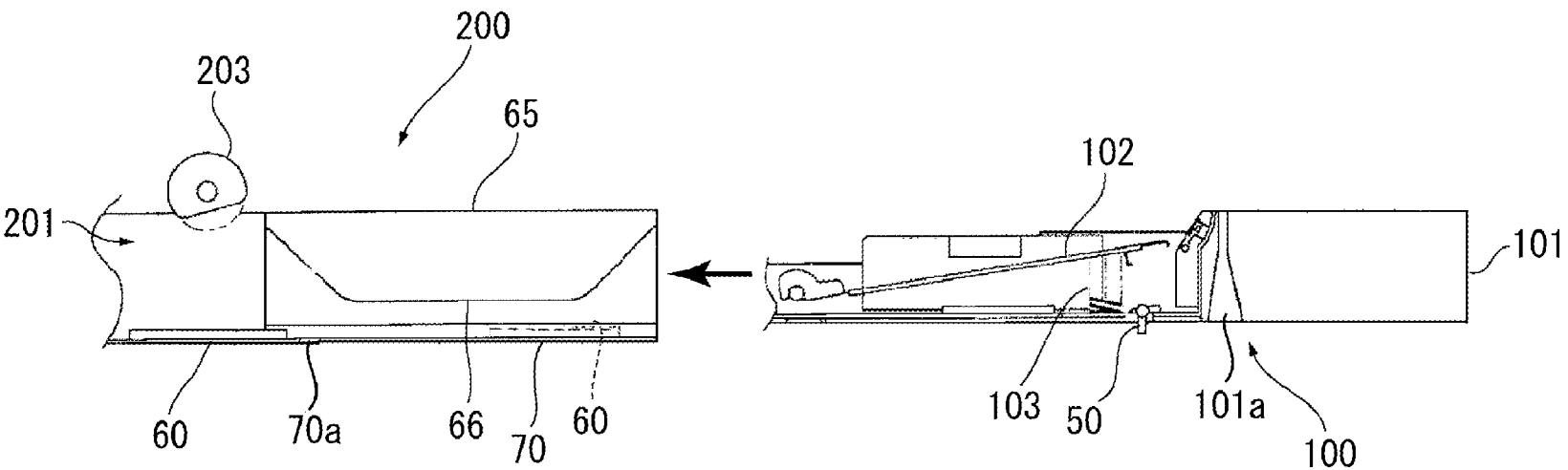
FIG. 6 (PRIOR ART)
FIG. 6 is a diagram illustrating the configuration of a cassette mounting unit provided in a conventional image forming apparatus and also illustrating the configuration of a conventional sheet cassette demountably mounted in the conventional cassette mounting unit.
Figure 7:
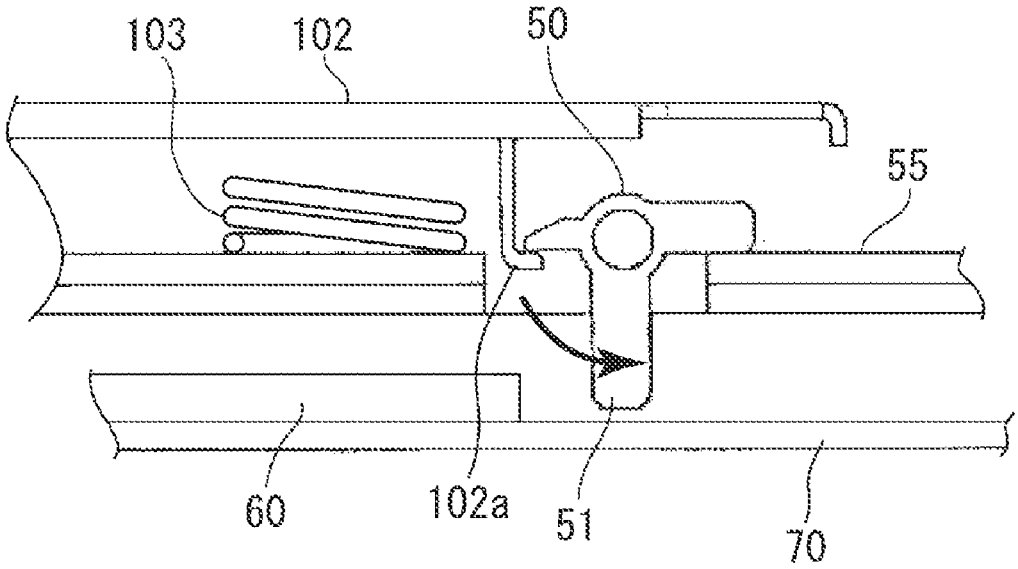
FIG. 7 (PRIOR ART)
FIG. 7 is a diagram illustrating a state in which a lifting plate provided in the conventional sheet cassette is locked by a conventional locking mechanism.

Thereafter, when the sheet cassette 1 is further drawn out, the releasing lever 31 is put into contact with the lock release member 40 provided at the entrance side of the cassette mounting unit 10D, as shown in FIG. 5B. Thus, the releasing lever 31 is turned in the opposite direction (direction opposite to the release position), that is, a direction opposite to the direction in which the lever 31 turns in the direction as shown in FIG. 5B.

However, in the present embodiment, the releasing lever 31 is provided as a member separated from the locking member 32. The abutting part 32*b* of the locking member 32 abuts against the abutment part 35, so that the locking member 32 is not turned. Accordingly, only the releasing lever 31 turns independent of the locking member 32.

Consequently, the sheet cassette 1 can be drawn out of the cassette mounting unit 10D in a state in which the lifting plate 2 is downwardly turned and is locked. The subsequent stacking, accommodation or replacement of sheets can be facilitated. The abutment of the releasing lever 31 against the lock release member 40 is released until the sheet cassette 1 is drawn out therefrom. Then, the releasing lever 31 is returned to the position indicated in FIG. 3 by the pushing force of the second pushing member 38.

Thus, when the sheet cassette 1 is mounted thereinto, the releasing lever 31 is turned integrally with the locking member 32. Consequently, the locking of the lifting plate 2 by the locking member 32 can be released. When the sheet cassette 1 is drawn out therefrom, the releasing lever 31 is singly moved. Consequently, the state of the lifting plate 2 locked by the locking member 32 can be maintained. Accordingly, the locking of the lifting plate 2 by the locking mechanism 30, and the release of the locking of the lifting plate 2 can surely be achieved. Also, a feeding failure and breakages of components can be prevented. Additionally, the user's operability of the sheet cassette 1 can be enhanced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-053719 filed Feb. 28, 2006, which is hereby incorporated by reference herein in its entirety.

What is claimed:

1. A sheet feeding apparatus, in which a sheet accommodating unit is demountably provided in an apparatus body, the sheet accommodating unit having a sheet accommodating member, a lifting plate pivotably provided in the sheet accommodating member, and a pushing member configured to push the lifting plate toward a sheet feeding unit, the sheet feeding apparatus comprising:

a locking mechanism configured to perform regulation of the lifting plate at a position to which the lifting plate descends against a pushing force of the pushing member, the locking mechanism including a pivotable locking member configured to regulate the lifting plate and a pivotable lock releasing lever configured to turn the locking member; and a lock release member configured to release the regulation of the lifting plate by the locking mechanism in response to mounting of the sheet accommodating unit in the apparatus body, wherein when the sheet accommodating unit is mounted in the apparatus body, the lock releasing lever is turned by the lock release member and turns the locking member to release the regulation of the lifting plate, and wherein when the sheet accommodating unit is drawn out of the apparatus body, the lock releasing lever is turned by the lock release member independently in a state in which the locking member regulates the lifting plate.

2. The sheet feeding apparatus according to claim 1, wherein the sheet accommodating member includes a regulation unit configured to regulate, when the locking member locks the lifting plate, turning of the locking member caused by the pushing force of the pushing member, wherein the locking member includes a catching part configured to catch the lifting plate, and an abutting part configured to abut when the lifting plate is locked, against the regulation unit of the apparatus body, and wherein the lock releasing lever includes an engaging part configured to engage, when moved in a lock releasing direction, with the locking member.

3. The sheet feeding apparatus according to claim 2, wherein the locking mechanism further includes:

a first pushing member configured to push the abutting part of the locking member in a direction in which the abutting part of the locking member abuts against the regulation unit; and a second pushing member configured to push the lock releasing lever in a direction in which the engaging part of the lock releasing lever is engaged with the locking member.

4. The sheet feeding apparatus according to claim 3, wherein the first pushing member and the second pushing member are constituted by a same pushing member.

5. The sheet feeding apparatus according to claim 1, wherein the locking member is provided below the lifting plate and at a central part in a width direction perpendicular to a sheet feeding direction of the lifting plate.

6. The sheet feeding apparatus according to claim 1, wherein the apparatus body includes a guide member adapted to lower, when the sheet accommodating unit is drawn out, the lifting plate against the pushing force of the pushing member to a position at which the lifting plate is locked by the locking mechanism.

7. An image forming apparatus including a sheet feeding apparatus in which a sheet accommodating unit is demountably provided, the sheet accommodating unit having a sheet accommodating member, a lifting plate pivotably provided in the sheet accommodating member, and a pushing member configured to push the lifting plate toward a sheet feeding unit, the image forming apparatus also including an image forming unit configured to form an image on a sheet fed from the sheet feeding apparatus, the image forming apparatus comprising:

a locking mechanism configured to perform regulation of the lifting plate at a position to which the lifting plate descends against a pushing force of the pushing member, the locking mechanism including a pivotable locking member configured to regulate the lifting plate, and a pivotable lock releasing lever configured to turn the locking member; and a lock release member configured to release the regulation of the lifting plate by the locking mechanism in response to mounting of the sheet accommodating unit in the apparatus body, wherein when the sheet accommodating unit is mounted in the apparatus body, the lock releasing lever abuts against the lock release member and turns to cause the locking member to turn to release the regulation of the lifting plate, and wherein when the sheet accommodating unit is drawn out of the apparatus body, the lock releasing lever is turned by the lock release member independently in a state in which the locking member regulates the lifting plate.

* * * * *